US005244431A

United States Patent [19]

D'Andrade

[11] Patent Number: 5,244,431

[45] Date of Patent: Sep. 14, 1993

[54] RECOILING TOY PISTOL WITH COCKING AND FIRING SOUND

[76] Inventor: Bruce M. D'Andrade, 3 Ten Eyck Rd., Readington Township, Hunterdon County, N.J. 08889

[21] Appl. No.: 870,351

[22] Filed: Apr. 17, 1992

[51] Int. Cl.[5] ..... A63H 5/04; A63H 33/30; A63H 33/00; G09B 33/00

[52] U.S. Cl. ..... 446/406; 446/473; 446/489; 434/18; 42/54

[58] Field of Search ..... 446/397, 398, 401, 404, 446/405, 406, 407, 473, 484, 485, 489, 144, 145; 434/18, 16; 42/54

[56] References Cited

U.S. PATENT DOCUMENTS

| | | | |
|---|---|---|---|
| 934,957 | 9/1909 | Bevington | 446/397 X |
| 1,961,564 | 6/1934 | Mars | 42/54 |
| 2,023,497 | 12/1935 | Trammell | 434/18 |
| 2,734,311 | 2/1956 | Christopher | 446/485 X |
| 2,741,872 | 4/1956 | Sigg . | |
| 2,770,916 | 11/1956 | Sigg . | |
| 4,007,934 | 2/1977 | Ochi | 434/18 X |
| 4,114,311 | 9/1978 | Chow . | |
| 4,175,353 | 11/1979 | Pickett . | |
| 4,365,439 | 12/1982 | Litynski . | |
| 4,750,641 | 6/1988 | Chin-Fu . | |
| 4,808,143 | 2/1989 | Kuo . | |
| 5,145,446 | 9/1992 | Kuo | 446/405 |

FOREIGN PATENT DOCUMENTS

| | | | |
|---|---|---|---|
| 474727 | 6/1951 | Canada | 446/406 |

*Primary Examiner*—D. Neal Muir

*Attorney, Agent, or Firm*—Kenneth P. Glynn

[57] ABSTRACT

The present invention is directed to a toy gun which has a housing with a main section and a handle, a barrel, a trigger, a battery holder, electrical connections, a printed circuit board, a sound amplifier/speaker, a recoiling weight and spring, and sufficient circuitry to generate a realistic firing sound of a fired gun. The barrel is connected to the main section of the housing and the trigger is connected to the housing such that it is pivotally mounted therein. The trigger has a finger portion below the pivot point and an engaging portion above the pivot point and is biased to a first position, e.g. via a spring, and, when the trigger is pulled, moves to a second position. The battery holder has connections for one or more batteries and the printed circuit board and sound amplifier/speaker have electrical connections to the battery holder and the speaker with a break in the electrical connection near the engaging portion of the trigger so that when the trigger is in its first position the electrical connection is incomplete and when the trigger is pulled, it is complete. The recoiling weight and spring are mounted in the housing or barrel and the spring biases the weight in a first position. The weight is movable to a second position and is movably and releasable connected to the engaging portion of the trigger such that when the trigger is pulled from its first to its second position, the weight is moved from its first to its second position and the weight is then released to cause a realistic physical recoil of the toy gun. In some embodiments, a cocking slider is included and the circuitry includes the realistic sound of a cocking slider being cocked and released.

10 Claims, 2 Drawing Sheets

RECOILING TOY PISTOL WITH COCKING AND FIRING SOUND

BACKGROUND OF THE INVENTION

1. Field of the Invention

The present invention involves a toy gun which has been developed to create realistic gun action, including the actual sound of a firing gun and realistic recoil effects. More specifically, the present invention is directed to a toy gun which utilizes electrical components as well as mechanical means to create these effects.

2. Prior Art Statement

Numerous patents have issued over the years to toy inventors which cover toy guns which create different types of effects. The following prior art patents illustrate the development of this art:

U.S. Pat. No. 2,770,916, issued to Joseph Sigg describes a trigger mechanism for toy guns which utilizes a trigger and spring arrangement to cause a barrel and a fin-like portion to reciprocate. However, the fin-like member and barrel can only create the sound of their materials of construction and there is no requirement of a weighted mass to create the feel of a recoil nor is there any electronic sounding mechanism. U.S. Pat. No. 2,741,872, also issued to Joseph Sigg, describes a multiple action toy gun which is indicated to be a space gun in which the ray ejector barrel is subject to rapid oscillatory movement in the gun stock by means of a cam actuated retractor mechanism. The actuator mechanism employs a resilient means for effecting oscillatory movement of the ray barrel complimented by sound which is resiliently mounted in the stock of the gun to assume a forward position from which it is displaced by a cam actuator retractor mechanism. It relies primarily on saw teeth and a trigger with a pawl whereby a single retractor stroke will cause repeated motion. Again, this patent does not teach the use of a circuit board to generate sound nor does it have the recoil mass which is a critical feature of the present invention.

U.S. Pat. No. 4,808,143 issued to Yi Kuo describes a toy machine gun which has a trigger associated with a micro switch. The micro switch engages a rotatable wheel through a reduction gear. A link assembly together with the rotatable wheel provides a reciprocating motion and creates a kick-back. In addition, the link assembly is arranged to actuate another micro switch which controls an audio circuit board and a speaker for generating a sound mimicking a gun shot. In this particular invention, there is no cocking slider and no recoil kick-back associated with the firing of the toy gun such as is found in the present invention which has mass associated with an integral part of the trigger mechanism so as to create the kick-back effect or recoil effect upon movement of the trigger. Further, the type of reciprocal motion of this prior art is not utilized in the present invention and this device achieves a different result using different means.

U.S. Pat. No. 4,750,641, issued to Hun Chin Fu describes a continuous water ejecting pistol with a simultaneous sound and red flashing effect. Again, this toy gun does not employ a recoil effect, a slidable cocking slider mechanism, nor the connected sounding system as in the present invention.

U.S. Pat. No. 4,365,439, issued to Zbigniew Litynski, describes a toy laser-type gun which incorporates light and sound sources for simultaneous generation of light pulses and sounds reminiscent of outer space laser gun when a trigger is depressed. One may wonder how the inventor could reminisce of outer space laser guns, but, nonetheless, this particular prior art patent employs reflectors and pulsating lights with electronic circuitry but, again, does not utilize a recoiled feature, a cocking slider, or the sounding system of the present invention.

U.S. Pat. No. 4,114,311 to Thomas Chow describes a toy gun having a barrel and a handle with a supporting pivoted trigger and a spring pressed hammer engagable with an elongated slide having drive teeth engagable with pinion drive means for a noise producing unit in the barrel which includes a vibratable spring that produces a sound resembling a ricocheting bullet. There is no provision for a cocking slider nor mass related thereto for effecting a realistic recoiling feel upon firing of the gun.

U.S. Pat. No. 4,175,353 describes a toy simulated ray gun which includes controllable audio and visual effects simulating a fictitious futuristic space age weapon. It includes electronic components with power source, timer means and audio generation means so as to generate sounds with either a single shot or a continuous high pitch or a blast sound that rapidly decays when the trigger is pulled to fire the gun and to simultaneously activate the lights according to a pre-selected mode. Again, this prior art patent does not describe the recoiling mechanism utilized in the present invention.

SUMMARY OF THE INVENTION

The present invention is directed to a toy gun which has a housing with a main section and a handle, a barrel, a trigger, a battery holder, electrical connections, a printed circuit board, a sound amplifier/speaker, a recoiling weight and spring, and sufficient circuitry to generate a realistic firing sound of a fired gun. The barrel is connected to the main section of the housing and the trigger is connected to the housing such that it is pivotally mounted therein. The trigger has a finger portion below the pivot point and an engaging portion above the pivot point and is biased to a first position, e.g. via a spring, and, when the trigger is pulled, moves to a second position. The battery holder has connections for one or more batteries and the printed circuit board and sound amplifier/speaker have electrical connections to the battery holder and the speaker with a break in the electrical connection near the engaging portion of the trigger so that when the trigger is in its first position the electrical connection is incomplete and when the trigger is pulled, it is complete. The recoiling weight and spring are mounted in the housing or barrel and the spring biases the weight in a first position. The weight is movable to a second position and is movably and releasable connected to the engaging portion of the trigger such that when the trigger is pulled from its first to its second position, the weight is moved from its first to its second position and the weight is then released to cause a realistic physical recoil of the toy gun. In some embodiments, a cocking slider is included and the circuitry includes the realistic sound of a cocking slider being cocked and released.

BRIEF DESCRIPTION OF THE DRAWINGS

The present invention will be more fully understood when the specification herein is taken in conjunction with the appended drawings, wherein.

DETAILED DESCRIPTION OF THE PRESENT INVENTION

The present invention involves a toy gun which may take the form of a pistol or something larger than a pistol such as a shortened rifle, a space gun, or the like. However, the present invention does specifically involve toy guns which have a movable cocking slider located atop the main portions of the toy gun itself. Specifically, there is a housing and a barrel connected to the housing and the housing includes a main portion and a handle. The critical features of the present invention include a realistic feel with respect to the recoil of the cocking slider coupled with a realistic sound of a firing gun. Additional features in preferred embodiments include sounding tied into the cocking of the slider and release of the slider which would be realistic cocking sounds and, in some embodiments, a relationship between the cocking of the slider and the subsequent release of the slider with the pulling of the trigger for the firing of the toy gun.

Figure 1:
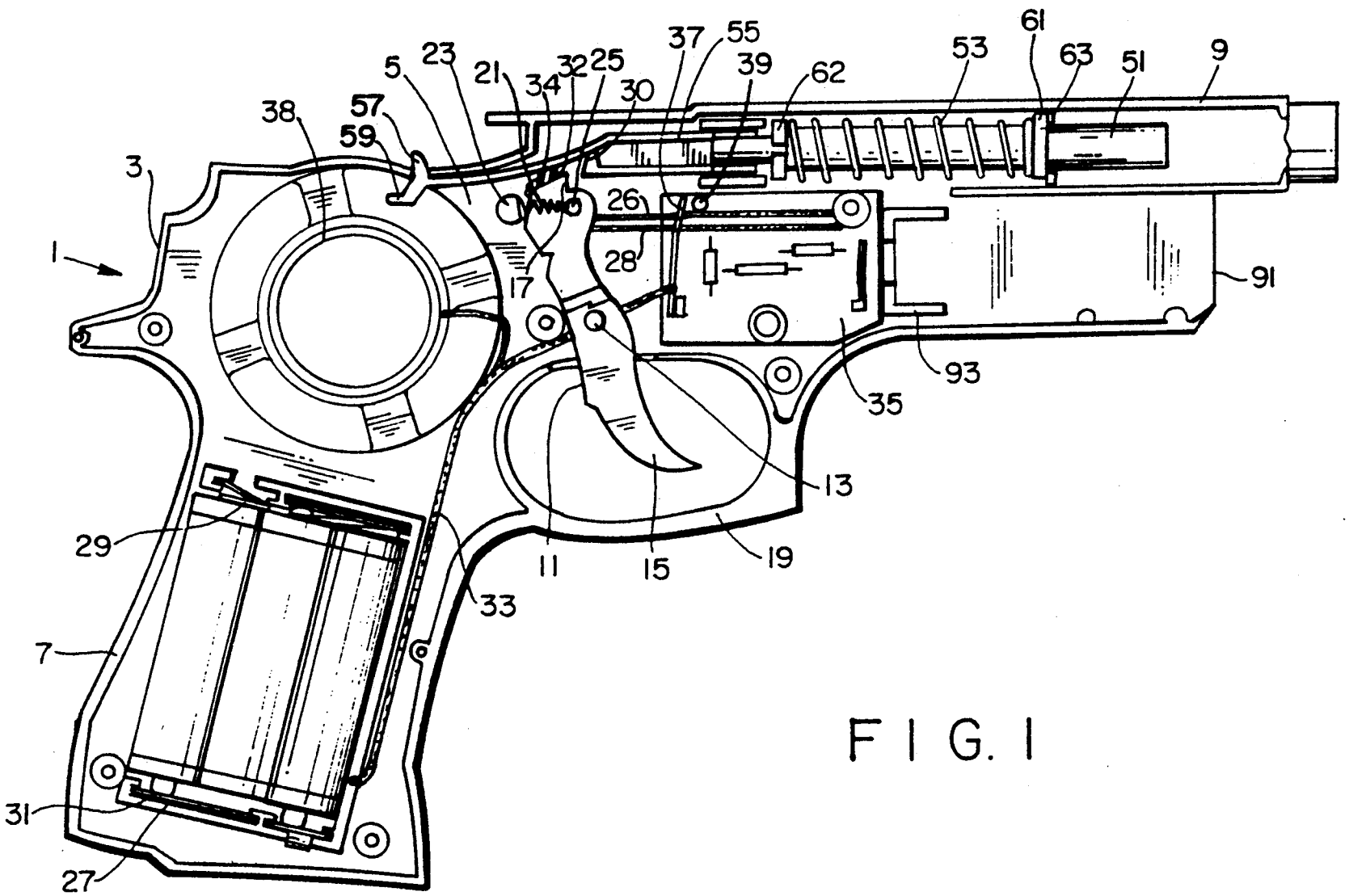
FIG. 1 shows a side, cut view of one embodiment of the present invention toy gun.

Referring now to FIG. 1, there is shown present invention toy gun 1 having housing 3 with a main section 5 and a handle 7. There is also included a barrel 9 connected to and extending from main section 5 of housing 3. A trigger 11 is connected to housing 3 and is pivotally mounted therein. In this embodiment there is a pivot point 13 and the trigger has a finger portion 15 located below the pivot point 13 and also has an engaging portion 17 located above pivot point 13. The finger portion 15 is located outside of housing 3 and the engaging portion 17 is located within housing 3. Further, in this embodiment, optional finger guard 19 is included as shown and these features are constructed to resemble a realistic pistol, in this particular embodiment.

The trigger 11 has biasing means 21. In this embodiment, it is a spring which is connected in a fixed position at one end 23 to housing 3 and at the other end 25, to engaging portion 17 of trigger 11. When the trigger is in its normal, biased position, this is referred to as its first position, it is as shown in FIG. 1. When trigger 11 is pulled at its finger portion 15, finger portion 15 moves back and engaging portion 17 moves forward to a second position. This second position causes one or more actions to occur as more fully described below.

A battery holder 27 is included in the housing 3 (and in this embodiment is actually located in handle 7 of housing 3). The battery holder 27 has connections for one or more batteries as represented by connections 29 and 31. These connections are soldered or otherwise electrically joined to electrical connections 33 which, in this case, are wires, although could be electrical paths printed within the housing or on a sub-straight located in the housing. Electrical connection 33 is connected to battery holder 27 for battery powering and is also connected to a printed circuit board 35 and an amplifier/speaker 38. It has a break in electrical connection 33, such as here with contact strip 37 connected to wire 33 and printed circuit board 35 contact 39. As shown in FIG. 1, contacts 37 and 39 are separated from one another. However, when trigger 11 is pulled, the engaging portion 17 pushes contact 37 to 39 and completes the circuitry so as to cause a realistic firing sound to be amplified and emitted from amplifier/speaker 38.

Printed circuit 35 has sufficient circuitry components so as to generate the aforesaid realistic firing sound, and, in preferred embodiments, utilizes digitally converted gun firing sound taken from the recording of the firing of an actual gun.

Figure 3:
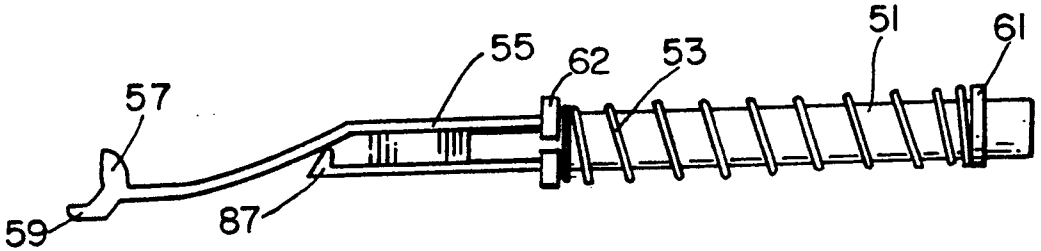
FIG. 3 shows a side view of the mass utilized in a present invention toy gun, along with its biasing mechanism and connecting mechanism.

Also shown in FIGS. 1 and 3 is a recoiling weight 51. This recoiling weight 51 has a spring 53 mounted thereon and has an extension member 55. Referring to FIG. 3 and FIG. 1, it can be seen that recoiling weight 51 with its biasing spring 53 has extension member 55 with ring 62, an upward protrusion 57 and paw 59. It also includes a ring stop 61 and, when recoiling weight 51 is mounted within the barrel 9 and housing 3 of toy gun 1, ring stop 61 rests behind barrel ring 63, as shown.

Figure 2:
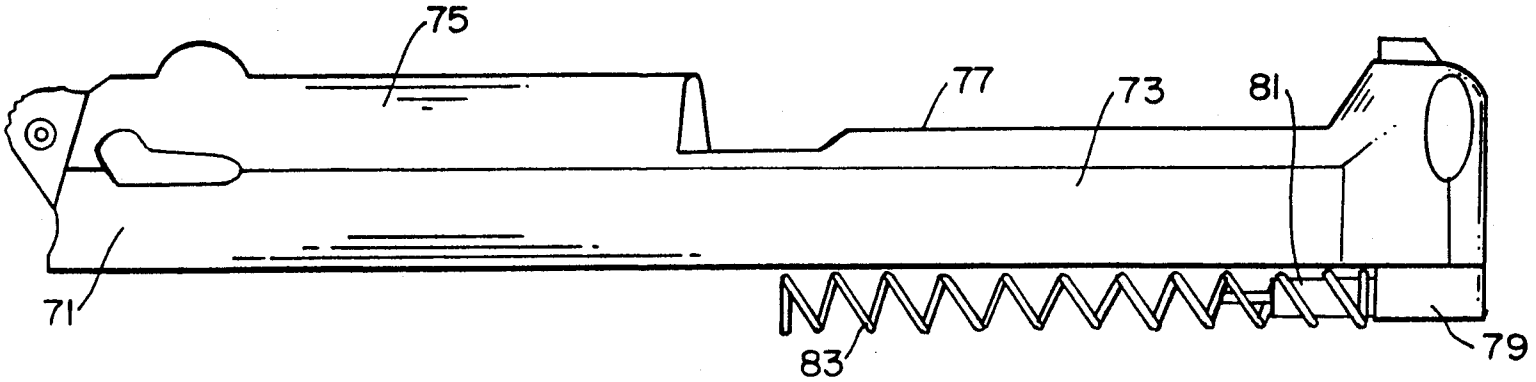
FIG. 2 shows a side view of a cocking slider which fits atop the barrel and housing of the present invention gun shown in FIG. 1.

Referring now to FIGS. 1, 2, and 3 simultaneously, FIG. 2 shows a cocking slider 71 which may be mounted atop barrel 9 and housing 3. Cocking slider 71 has an upper portion 75 which goes over the top of housing 3 and has a front portion 73 with an opening 77 which fits over barrel 9 and exposes a portion of the top of barrel 9. It also has a lower frontal section 79 with a spring holder 81 and a spring 83. When cocking slider 71 is mounted on the toy gun 1 shown in FIG. 1, spring 83 fits into housing opening 91 and rests against spring stop 93. This causes cocking slider 71 to be biased in a forward position. When it is pulled back to its rearward position, it closes optional circuitry 26 and 28. Thus, when extension member 55 is pulled back to its rearward position, heel 30 closes contact 32 against contact 34 to complete the circuitry with components located in circuit board 35 to generate a clicking sound which is a realistic sound of a slider being cocked. Preferably, this is a digitalized recording or representation of a recording of an actual slider being cocked on a pistol.

When trigger 11 is pulled back and its engaging portion 17 moves forward, it will not only close contacts 37 and 39 as discussed above, but it will also push forward the recoiling weight 51 to its forward position contacting paw 87 of extension 57 of recoiling weight 51. As trigger 11 reaches its second position, recoiling weight 51 gets pushed forward and is then released. Due to its mass, which is of sufficient weight to create a realistic physical recoil feel and due to the strength of the spring as well, the user, upon pulling the trigger generates both the realistic firing sound mentioned above and the realistic recoil.

Slider 71 is pulled back and released and, as mentioned, a cocking click is generated. This is optional but preferred. Further, in another preferred embodiment, two clicking sounds are generated, one as the slider is being brought back to its rearward position, and a second clicking sound, when the slider has been released and is moving toward its forward position once again.

As mentioned, the toy gun 1 of the present invention may take other forms without exceeding the scope of the invention. Further, the slider may or may not be included and may take on a shape different from the shape shown and may or may not have a cut-out for exposing a portion of the barrel. The toy guns may be constructed of metal or plastic, but is preferably constructed of a combination of materials which will be inexpensive to manufacture and yet durable enough to minimize failure and breakage. Further, the battery holder may be designed to handle a single battery of conventional sizes or two or three batteries, such as, for example, three 1.5 volt size AA. Additional features such as safety locks, or other features which are found on actual guns may be included. Alternatively, if the toy gun of the present invention were to take on the form of a futuristic pistol or weapon or space gun, other sounds could be included as well, such as warning signals, and various lighting features could be include with conventional wiring to the power source and connecting this with breaks so that the trigger mechanism will complete the circuit when pulled.

Obviously, numerous modifications and variations of the present invention are possible in light of the above teachings. It is therefore understood that within the scope of the appended claims, the invention may be practiced otherwise than as specifically described herein.

What is claimed is:

1. A toy gun, which comprises:

(a) a housing having a main section and a handle;

(b) a barrel connected to and extending from said main section of said housing;

(c) a trigger connected to said housing and pivotally mounting therein, said trigger having a finger portion below a pivot point and located outside of said housing, and having an engaging portion above said pivot point and located inside of said housing and having biasing means connected thereto so as to bias said trigger to a normal, first position, and having a second position when said trigger is pulled;

(d) a battery holder and connections for one or more batteries, located within said housing;

(e) a printed circuit board and a sound amplifier/-speaker with electrical connection to said battery holder and to said sound amplifier/speaker with a break in the electrical connection near said engaging portion of said trigger such that when the trigger is in its first position, the electrical connection is incomplete and when pulled to its second position, the electrical connection is complete, said circuit board having sufficient circuitry components to recreate a realistic firing sound when said electrical connection is complete; and, (f) a recoiling weight and spring mounted in said housing or barrel, said spring biasing said weight in a first position, said weight being movable to a second position, said weight being movably and releasably connected to the engaging portion of said trigger such that when said trigger is pulled from its first position to its second position, said weight is moved from its first position to its second position and released, said weight being of sufficient mass and said spring being of sufficient strength to cause a realistic physical recoil of said toy gun.

2. The toy gun of claim 1, wherein said circuitry components include digitally converted gun firing sound from the firing of an actual gun.

3. The toy gun of claim 1, wherein said weight and spring are mounted, at least in part, in said barrel and at least the weight extends back into said housing.

4. The toy gun of claim 1, wherein said biasing means for said trigger is a spring having one end fixed to said housing and another end attached to said trigger.

5. The toy gun of claim 1, which further comprises:

(g) a cocking slider which is slidably located atop said housing and has a forward position and a rearward position and is biased toward said forward position.

6. The toy gun of claim 5, wherein said circuit board has additional electrical connection and additional circuitry components sufficient to create realistic cocking click sound, with additional electrical connection having a break therein and located proximate to said cocking slider, and wherein said cocking slider has means for closing said break in said additional electrical connection when said cocking slider is slid from its forward position to its rearward position.

7. The toy gun of claim 6, wherein said circuitry components include a digitally converted gun cocking sound from the cocking of an actual gun.

8. The toy gun of claim 6, wherein there are additional circuitry components sufficient to create a realistic cocking release click sound so that two separate clicking sounds are created when cocking slider is slid to its rearward position and released.

9. The toy gun of claim 7, wherein there are additional circuitry components sufficient to create a realistic cocking release click sound so that two separate clicking sounds are created when cocking slider is slid to its rearward position and released.

10. The toy gun of claim 6, wherein said realistic firing sound may be actuated with said trigger without said cocking slider having to be slid to its rearward position and released.

* * * * *